United States Patent [19]

Shader et al.

[11] 4,236,587

[45] Dec. 2, 1980

[54] GROUND-WORKING APPARATUS AND HITCH ASSEMBLY THEREFOR

[75] Inventors: Benjamin A. Shader, Golden; Bruce H. Mayeda, Longmont, both of Colo.

[73] Assignee: The Eversman Mfg. Company, Denver, Colo.

[21] Appl. No.: 32,281

[22] Filed: Apr. 23, 1979

Related U.S. Application Data

[62] Division of Ser. No. 869,852, Jan. 16, 1978.

[51] Int. Cl.[3] ..... E02F 3/76

[52] U.S. Cl. ..... 172/779; 172/451; 172/456; 172/780

[58] Field of Search ..... 172/4.5, 229, 272, 439, 172/449, 450, 451, 197, 199, 200, 456, 459, 494, 662, 779, 780, 782, 802; 37/42 R, 42 VL; 280/415 R, 415 A, 446 A, 456 A, 460 A, 461 A, 477, 479 R, 491 R, 491 C

[56] References Cited

U.S. PATENT DOCUMENTS

| | | | |
|---|---|---|---|
| 2,478,736 | 8/1949 | Balzer | 280/477 |
| 2,583,897 | 1/1952 | Smeds | 172/450 X |
| 2,697,393 | 12/1954 | Gardner | 172/451 X |
| 3,032,902 | 5/1962 | Shumaker | 172/4.5 |
| 3,090,141 | 5/1963 | Shumaker | 172/779 |
| 3,428,335 | 2/1969 | Clark | 280/479 R |
| 3,524,269 | 8/1970 | Jackoboice | 37/42 R |
| 3,967,684 | 7/1976 | Haverdink | 172/311 |
| 4,047,574 | 9/1977 | Foreman | 172/200 X |
| 4,090,725 | 5/1978 | Perin | 280/460 A X |
| 4,126,328 | 11/1978 | Old | 280/415 A |

*Primary Examiner*—Richard T. Stouffer
*Attorney, Agent, or Firm*—Ancel W. Lewis, Jr.

[57] ABSTRACT

Land leveling apparatus includes a leveling attachment drawn by a tractor with the attachment having pivotally connected side blade sections on a central blade section affording a substantially greater leveling capacity. The side blade sections fold up to reduce width during transport and have a power-driven linkage arrangement for each blade section that moves and positions the blade sections and locks them in the lowered working position, together with upper and lower level adjustments for the side blade sections. A hitch assembly facilitates quick coupling to a crossbar carried by the lower links of the tractor linkage and is pivotally joined to the central blade section so as to facilitate rear tractor wheel movement independently of the scraper blades. A leveling frame is connected at the front end to the central blade section and the pivotal attachments of the hitch assembly to the tractor linkage with the central blade section provide a four-bar linkage leveling structure that automatically moves in response to tractor movement to maintain the scraping edge substantially in a ground plane of the rear leveler frame wheels and front wheels of the tractor independently of the vertical movement of the rear wheels of the tractor.

14 Claims, 15 Drawing Figures

GROUND-WORKING APPARATUS AND HITCH ASSEMBLY THEREFOR

This is a division of application Ser. No. 869,852, filed Jan. 16, 1978.

FIELD OF THE INVENTION

This invention relates generally to earth moving equipment and more particularly to improvements in land leveling apparatus.

BACKGROUND OF THE INVENTION

Apparatus for leveling and smoothing land has heretofore been used for a variety of agricultural and industrial applications for maintenance and tillage operations. In humid areas this equipment has been used to correct surface drainage and for seed bed filling, and on rolling fields to fill and erase small washes and gullies, smooth terraces and benches, and shape up waterways. For industrial applications land levelers are used to work and smooth the land for landscaping and by contractors.

In U.S. Pat. Nos. 2,994,977 and 3,090,141, assigned to the assignee of the present invention, there is disclosed land leveling apparatus having automatic leveling features that maintain the cutting blade on the field grade plane independently of the vertical travel of the rear tractor wheels. The present invention provides advances in implements of the land leveling type and more particularly in apparatus capable of smoothing a wider area with each pass over a field while maintaining the cutting edge in a horizontal plane. In providing a land leveling apparatus of increased width the land leveler apparatus of the present invention is capable of handling greater weights, supporting a wider span, providing required widths during travel on the highway, and avoiding any tendency of the outer extremities of the scraper blade to dip and gouge the ground on turns.

Accordingly, it is an object of the present invention to provide novel and improved apparatus generally of the earth moving type.

Another object of the present invention is to provide a novel land leveling apparatus having a substantially greater leveling capacity.

Still another object of the present invention is to provide a novel land leveling attachment having articulated side blade sections that fold up for transport purposes, have upper and lower level adjustments and are positively locked in the lowered working position.

A further object of the present invention is to provide a novel and improved hitch for a land leveling attachment that affords efficient coupling and decoupling with a conventional hydraulically powered tractor linkage and allows both vertical and twisting motion of the tractor independently of the leveling attachment.

Yet another object of the present invention is to provide a novel and improved automatic leveling assembly for a land leveling apparatus that adjusts as the tractor moves up and down to maintain the scraping edge of the scraping blade in the ground plane of the rear leveler frame wheels and front tractor wheels independently of the vertical movement of the rear tractor wheels.

Still a further object of the present invention is to provide a novel and improved land leveling attachment that is readily adapted to different categories of tractor linkages.

SUMMARY OF THE INVENTION

The land leveling apparatus disclosed includes a land leveling attachment releasably hitched to the hydraulically operated three-point linkage on a tractor. The attachment has articulated side blade sections pivotally connected to a central blade section that are hydraulically moved via linkage arms between raised and lowered positions and are positively locked in the lowered position by an over-center linkage lock together with upper and lower level adjustments for the side blade sections. A hitch on the leveling attachment includes a pair of lower hitch arms that are pivotally connected at their rear ends to said central blade section to provide a rotary or twisting motion of the lower hitch arms relative to said central blade section about both a longitudinal axis and a lateral axis. The lower hitch arms have downfacing receiving sockets at the forward ends which cooperate with an adjustable-length crossbar secured to the rear links of the tractor linkage. The lower hitch arms are adjustable to more than one hitch category. An automatic leveling frame with rear wheels connects at the front end to the central blade section and the hitch, central blade section, and tractor linkage form a four-bar leveling linkage with pivot points at each corner that maintains the scraping blade edge in a grading plane contacted by the front wheels of the tractor and the leveling frame rear wheels independently of the vertical movement of the rear wheels of the tractor. A setting of the caster and camber on the rear wheels avoids undue digging in of the scraping edge at the ends on turns.

Other objects, advantages and capabilities of the present invention will become more apparent as the description proceeds, taken in conjunction with the accompanying drawings in which like parts have similar reference numerals and in which.

DESCRIPTION OF THE PREFERRED EMBODIMENTS

Figure 1:
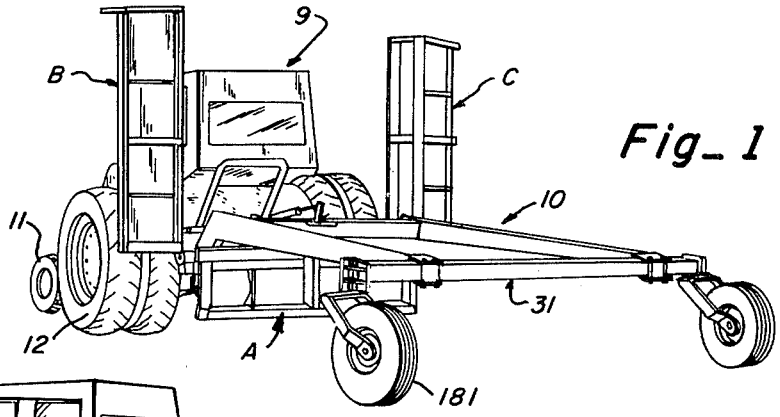
FIG. 1 is a rear perspective view of land leveling apparatus embodying features of the present invention with the articulated side blade sections in the raised transport position.

Referring now to the drawings, there is shown a prime mover 9 in the form of a farm tractor to which is releasably hitched a land leveling implement or attachment 10 that is pulled by the tractor in a land leveling operation. The tractor 9 shown has a pair of front wheels 11, two pairs of rear wheels 12, and a rear axle housing 13. The hitching linkage shown attached to the rear axle housing 13 of the tractor 10 is a conventional arrangement for the releasable attachment of the tractor to a three-point hitch implement and is hydraulically powered by the hydraulic power equipment on the tractor.

This three-point hitching linkage carried by the tractor includes an adjustable upper link 15 arranged along a longitudinal center line of the attachment and a pair of laterally spaced lower links 16 on opposite sides of a longitudinal center line of the attachment each articulated or pivotally connected to the rear axle 13 at its forward end and releasably connected to a crossbar 17 of a particular construction at its rear end. The pivotal connection of the upper link 15 to the rear axle housing 13 is referred to as the upper link point 18 and the pivotal connection of each of the lower links to the tractor is referred to as a lower link point 19. Each of the lower links is moved up and down relative to the lower link points 19 by means of a link 21 connected at one end to an intermediate position on lower link 16 at a pivot 22 and at the other end to a link 23 at a pivot 24. A two-way hydraulic cylinder 25 is connected to link 23 at a pivot 26 and to link 16 at a pivot 27. Cylinder 25 is coupled to the hydraulic system of the tractor to raise and lower the lower links relative to the lower link points 19 in response to hydraulic fluid being supplied to cylinder 25.

The land leveling attachment 10 in general includes a blade assembly 28, a hitch assembly 29 secured to and extending forwardly of the blade assembly, and a leveling assembly 31 secured to and extending rearwardly of the blade assembly.

Figure 2:
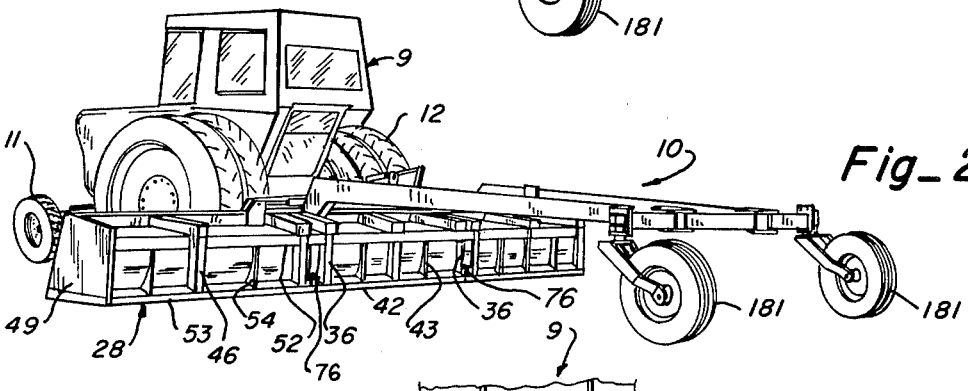
FIG. 2 is a rear perspective view of the land leveling apparatus shown in FIG. 1 with the articulated side blade sections in a lowered working position.
Figure 3:
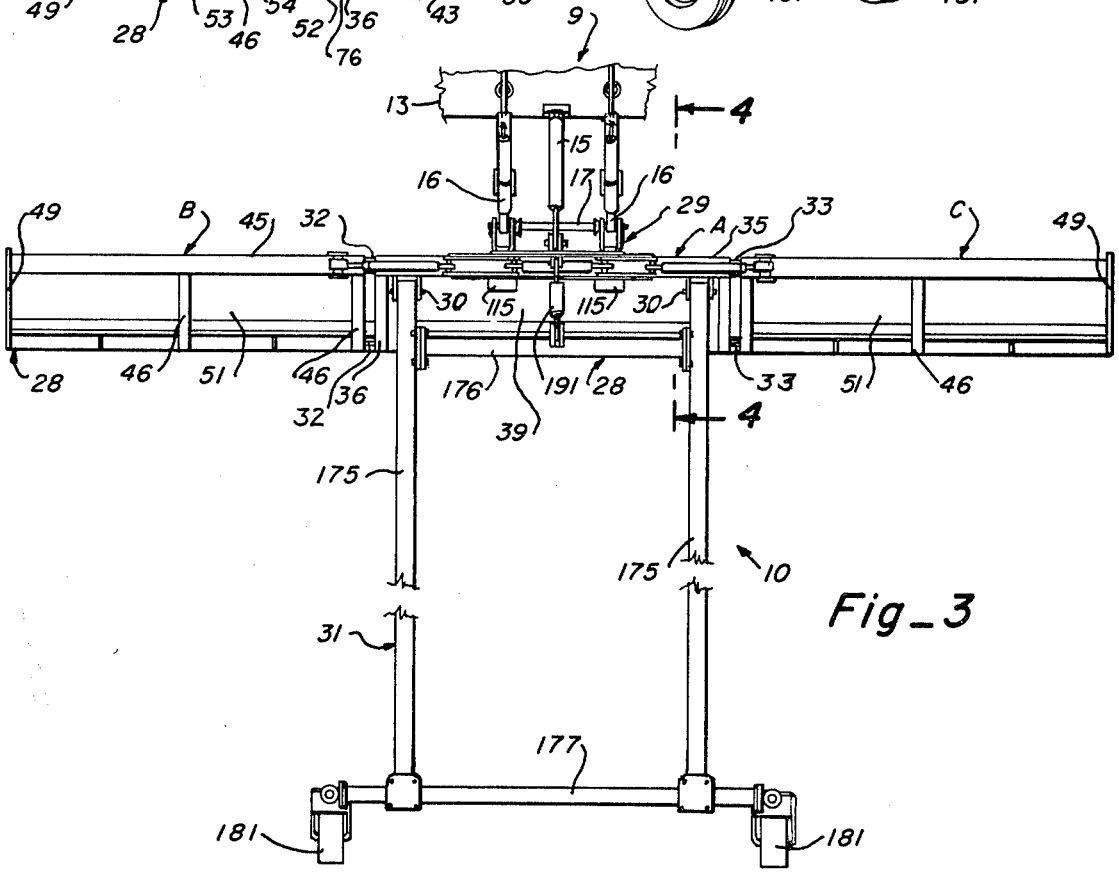
FIG. 3 is a top plan view of the apparatus shown in FIG. 2 with only the rear portion of the pulling tractor shown.
Figure 4:
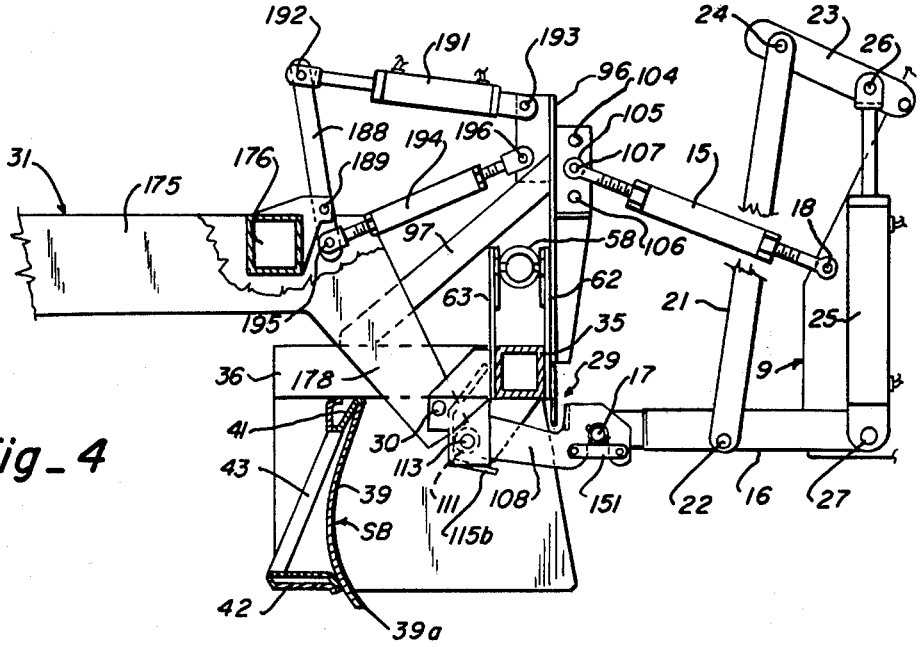
FIG. 4 is a sectional view taken along line 4—4 of FIG. 3.

The blade assembly 28 has a sectional scraping blade SB and includes a central blade section A which in turn has two articulated left and right side blade sections B and C, respectively, pivotally connected at forward and rear pivots 32 and forward and rear pivots 33, respectively, these pivots being on the upper part at the opposite ends of the central blade section A. The side blade sections B and C pivot relative to the central blade section between a lowered working position (FIG. 2) in which the side blade sections extend laterally out from the ends of the central blade section and a raised inboard position (FIG. 1) in which they extend up from the ends of the central section.

The central blade section A has a supporting frame including a tubular cross frame member 35 of square cross section with three laterally spaced knee frames 36 at an intermediate and end positions each connected to the back side of the cross frame member 35 and extending rearwardly and downwardly therefrom. An arcuate scraping blade member 39 is mounted in a depending manner from the underside of a horizontal portion of each of the knee frames and is affixed at the back to an upright portion of each of the knee frames and has a lower scraping edge 39*a*. An upper crossbar 41 and a lower crossbar 42 extend across the back of the upper and lower portions, respectively, of the blade and intermediate back braces 43 are provided between the knee frames along the back side for additional strength.

Each of the side blade sections B and C is of an identical construction arranged for left and right side operation and is of a construction similar to the central blade section A. Each side blade section has a tubular cross frame member 45 of square cross section with knee frames 46, one at an intermediate position and another at an inner end position, and an outer end plate 49 that also forms a structural support like a third knee frame at the outer end. Each side section has an arcuate scraping blade member 51 aligned with scraping blade member 39 mounted in a depending manner affixed to the back of the knee frame 46, an upper crossbar 52, a lower crossbar 53, and back braces 54. Scraping blade members 51 and 39 arranged end-to-end in the working position form the composite scraping blade designated SB.

An identical linkage assembly 56 is connected between each side blade section B and C and the central blade section A which in general serves to lock the associated side section in the lowered working position and is responsive to the linear movement of a common two-way hydraulic actuator 58 to simultaneously raise and lower the side blade sections and to hold the side blade sections in the raised position. Each linkage assembly 56 includes a lever arm 59 fulcrumed at a pivot 61 between a front support plate 62 and rear support plate 63 that is secured to and projects up from the cross frame member 35. An adjustable link 64 has one end pivotally connected at pivot 65 to one end of the lever arm 59 and the other end is pivotally connected at a pivot 66 on a bracket plate 67 projecting up from the top of the associated side blade section.

Figure 8:
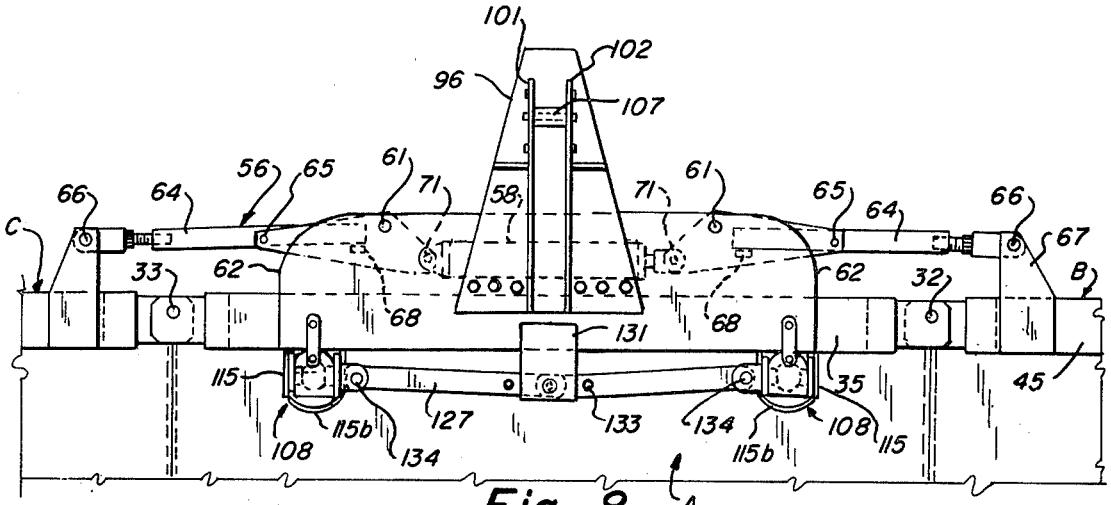
FIG. 8 is a front elevational view of a central portion of the land leveling attachment shown in FIGS. 1–7 with the side blade sections in the lowered working position and the lower hitch arms in the raised, non-hitch position.
Figure 9:
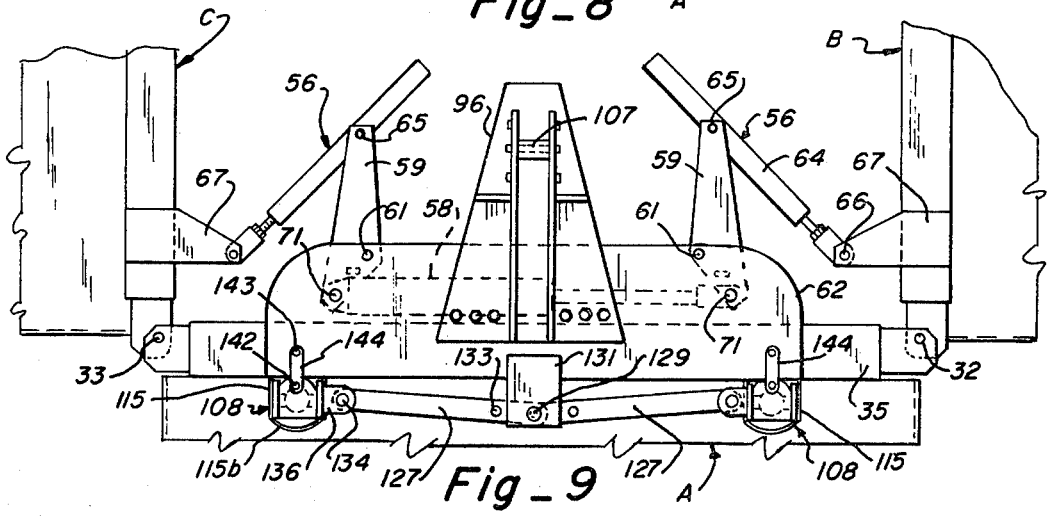
FIG. 9 is a front elevational view of the central portion of the land leveling attachment shown in FIG. 8 with the side sections in the raised inboard transport position.

In the lowered working position for the side blade sections shown in FIG. 8, the adjustable link 64 and lever arm 59 are substantially end-to-end and substantially in line with the pivot 65 at a slight over-center position below a horizontal line passing through pivots at 61 and 66. This over-center arrangement locks the side blade sections in the lowered working position. A stop 68 is provided on the lever arm 59 against which the free end of the adjustable link 64 will abut to prevent the link 64 and lever arm 59 from going too far past the over-center position.

The opposite ends of the two-way hydraulic actuating cylinder 58 are pivotally connected at a pivot 71 on each lever arm 59 opposite pivot 65 and offset to one side of a line passing through pivots 61 and 65 so that, as the actuating cylinder 58 is expanded to increase the effective length between the ends thereof, both lever arms 59 rotate or swing simultaneously from a generally laterally outwardly extending position to an upright position, which pulls the adjustable link 64 from a horizontal to an upwardly and inwardly inclined position forming an acute inside angle between the lever arm 59 and the associated link 64, causing the side blade sections B and C to pivot to the upright position about their respective pivots 32 and 33. The side sections B and C are then held in the upright or folded position by the pair of linkage assemblies 56 and hydraulic actuator 58 powered by the hydraulic system of the tractor.

Figure 10:
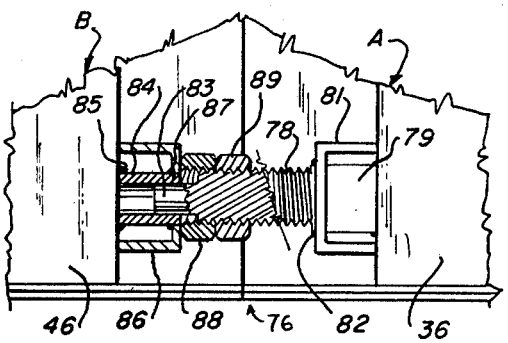
FIG. 10 is a rear elevational view of a lower level adjustment between the central and side blade sections with portions shown in section.

An identical lower level adjustment 76 is provided for each of the side blade sections B and C for their adjustment relative to the central blade section A. As best seen in FIG. 10, the lower level adjustment 76 includes an externally threaded member 78 affixed at one end to the central blade section A as by welds 79 and further by a bracket 81 secured to the knee frame 36 and to the threaded member at welds 82. The threaded member 78 projects laterally out and terminates in a narrowed stepped end portion 83 that is slidably inserted into an aperture in sleeve 84 affixed to the knee frame 46 of blade section B by welds at 85 and to a bracket 86 as by welds indicated at 87.

An adjustment nut 88 threads on the end of the threaded member against the bracket 86 so that threading in one direction will raise the side blade section B slightly and in the other direction will lower the side blade section B slightly. A lock nut 89 threads on the threaded member 78 against nut 88 to lock the level adjustment at a particular setting. The lower level adjustment is normally set with the side blade section B level and does not require further adjustment. The upper level adjustment is provided by threading the adjustable links 64 in the linkage 56 used for raising and lowering the side blade sections, as above described.

The hitch assembly 29 includes an upright mast plate 96 affixed to the front support plate 62 and further supported by an inclined brace 97 connected between mast plate 96 and knee frame 36. The mast plate 96 shown has two laterally spaced, parallel, forwardly projecting flanges 101 and 102 provided with three pairs of vertically spaced apertures 104, 105 and 106 each adapted to slidably receive an upper hitch pin defining a pivot 107. The rear end of the upper link 15 inserts between flanges 101 and 102 and has an aperture that alines with a pair of alined apertures in the mast plate flanges and the hitch pin 107 slide-fits in one of the three alined apertures to pivotally and releasably connect the rear end of the upper link 15 to the mast plate 96 at a pivot 107.

The hitch assembly 29 further includes two laterally spaced lower hitch arms 108 each pivotally connected at its rear end to the central blade section A at a side pivot connection. Each side pivot connection is of a universal-type joint with a ball connector 111 mounted on a lateral shaft 113 supported in a housing 115 affixed to blade section A. Each ball connector 111 is provided with an outer spherical race **111*a* inserted into and held in an aperture 119 in the rear end of arm 108 and an inner ball portion 111*b* movable in the race that is affixed to shaft 113 so that each hitch arm 108 rotates relative to blade section A about both a longitudinal axis and a lateral axis at its pivotal connection, providing for limited up and down movement and also twisting movement about a longitudinal axis of the tractor independently of the position of the blade sections. Optionally, a single common center point pivotal connection may be used in place of the two side pivot connections wherein the rear ends of both hitch arms are secured to and pivot with a common cross-bar pivoted at its center by an enlarged version of fixed center pivot pin 129** described hereinafter.

Figure 11:
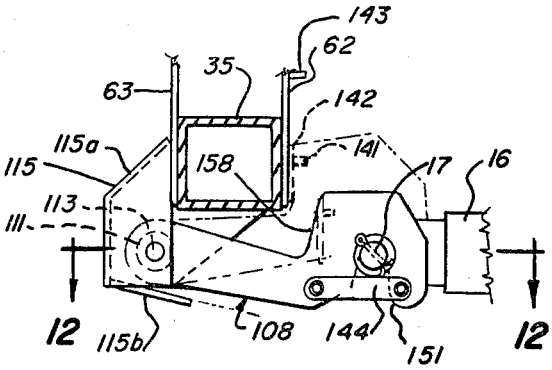
FIG. 11 is a side elevational view of one of the lower hitch arms connected to the tractor linkage with a range of pivotal movement in the raised position shown in dashed lines.
Figure 12:
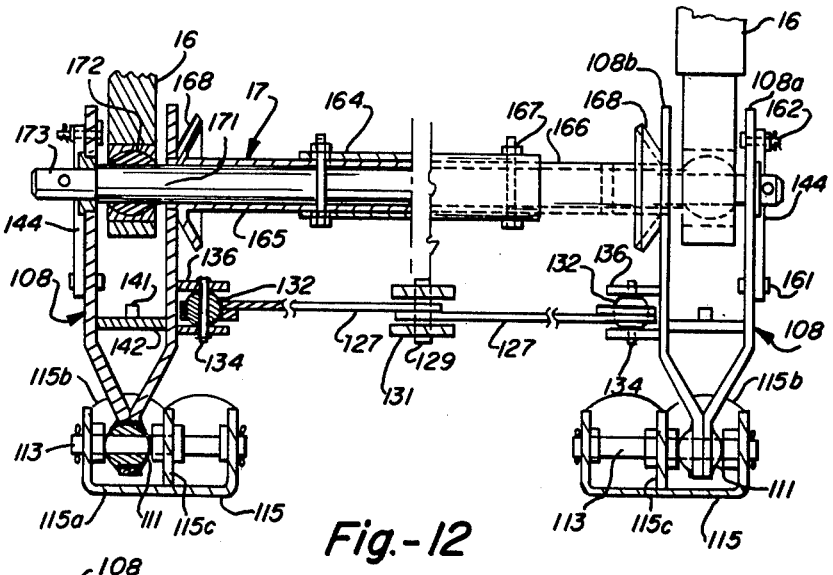
FIG. 12 is a sectional view taken along lines 12—12 of FIG. 11.
Figure 13:
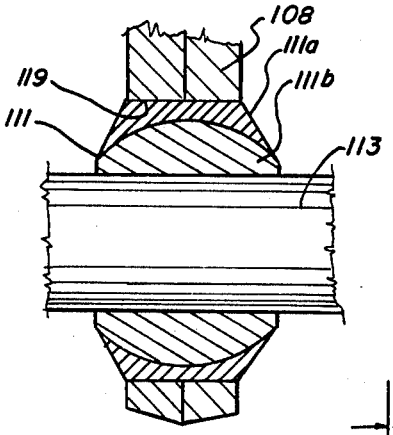
FIG. 13 is an enlarged sectional view of the ball connector pivotally securing the rear end of each of the lower hitch arms to the central blade section.

Each housing 115 has a back wall portion **115*a* and a lower wall portion 115*b* on which the associated hitch arm 108 rests in a lowered position, as shown in dashed lines in FIG. 11. The housing 115 shown is constructed with an intermediate wall portion 115*c*** providing a section for a category II hitch and a section for a category III hitch.

For the side pivot connection each hitch arm 108 is secured against lateral movement during turns by a cross link 127. Cross link 127 is pivotally connected to pivot in a vertical plane at an inside end at a common center fixed pivot pin 129 on a bracket 131 affixed to the center frame member 35. Each cross link 127 is provided with a second aperture 133 to facilitate adjustment for a category II hitch.

The outer end of each cross link 127 is pivotally connected to an associated lower hitch arm 108 by a ball connector 132 having a pivot pin 134 connected to a bracket 136 secured to the inside of the hitch arm 108 between the front and rear ends of the hitch arm. No cross links 127 or associated structure is required for the center pivot hitch connection. Each hitch arm 108 is normally held in the upper position, shown in FIG. 11, during transport by a pin 141 on a bracket 142 and a pin 143 on front plate 62. The same link 144 with holes at the opposite ends preferably is used as that which releasably holds the crossbar 17 to the lower hitch arms 108.

Each of the hitch arms 108 has a down-facing socket 151 at its front end that slidably receives an end portion of crossbar 17 carried by the lower draft links 16 and 17 of the tractor. Each hitch arm 108 is of a bifurcated construction including a pair of laterally spaced arm plate portions **108*a* and 108*b* joined at their rear ends which carry the ball connector 111 and open at the front ends to slidably receive the rear end portion of a lower draft link 16**.

The two bifurcated plate portions **108*a* and 108*b* are each provided with a down-facing slot alined with one another having rounded corners to form the socket 151 at the front end that slidably receives the crossbar 17. In use the crossbar 17 is normally lowered under the sockets and raised into position by actuating cylinder 25. The plates are wider at the front end and have a notched area 158 at the rear that fits up against the frame member 35 in the raised transport position, as shown in dashed lines in FIG. 11. The link 144 with holes at each end is releasably supported across the slot opening on arm 108 by pins 161 and 162** to releasably fasten the crossbar to the lower hitch arms.

The crossbar 17 has a lengthwise adjustment feature to facilitate its use with either a category II or a category III hitch. The hitch is shown in a category III setting. The adjustable crossbar 17 includes a central tubular member 164 in which end tubular members 165 and 166 are telescopically and slidably received. Adjustment bolts 167 and apertures in members 164, 165 and 166 facilitate the shortening of the effective length thereof. Each end tubular member has an external guide flange 168 that guides the crossbar into position between the plates **108*a* and 108*b* of the bifurcated lower hitch arms 108. Each end tubular member 166 carries an end shaft 171 with an external diameter that slides into a ball connector 172 in the lower link 16** and an end section 173 of reduced diameter that extends beyond the associated lower hitch arm 108. In the adjusting of the hitch assembly for a category II hitch, the crossbar 17 is shortened in length and the base connectors 111 are positioned in the inside sections of housing 115.

The automatic leveling assembly 31 includes a generally open, box-shaped, leveling frame including two laterally spaced, parallel, hollow side members 175 on opposite sides of a longitudinal center line, a hollow front cross member 176, and a hollow rear cross member 177. Each side member has a downturned front end portion 178 pivotally connected to the rear outer end portion of cross frame member 35 at a pair of laterally spaced pivots 30 on opposite sides of a longitudinal center line of the attachment. The rear end of the leveling frame is supported for vehicular movement on a pair of laterally spaced wheels 181 mounted on end extensions of the rear cross member 177.

Figure 14:
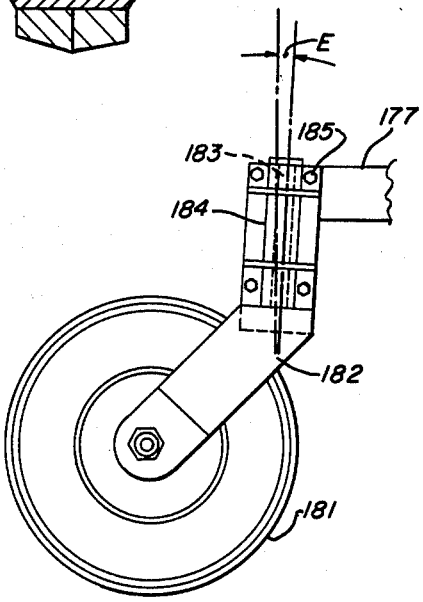
FIG. 14 is a side elevational view of one of the leveling frame wheels.
Figure 15:
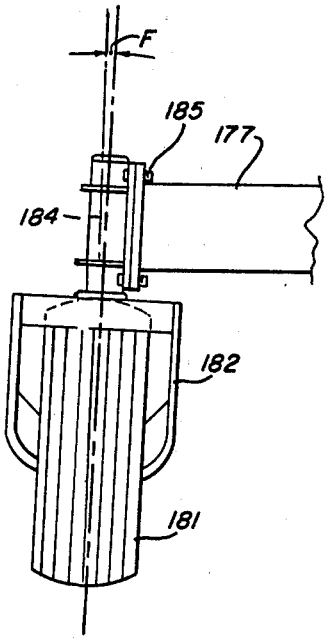
FIG. 15 is a rear end view of one of the leveling frame wheels.

Referring now to FIGS. 14 and 15, each wheel 181 is carried by a caster bracket 182 with a stub shaft 183 rotated in a journal 184. The journal 184 is secured to the end extension of the cross member 177. The wheels are set on a selected caster designated by angle E and a camber designated by angle F in FIGS. 14 and 15 to avoid a digging in at the ends of the side blade sections during a turning movement. A preferred caster angle E is about three degrees and a preferred camber angle F is about one-half degree.

The depth of the scraper blade may be selectively, manually adjusted by means of a four-sided or four-bar linkage arrangement including a link 188 connected at a pivot 189 to the cross member 176 having one end connected to one end of a two-way hydraulic cylinder 191 at a pivot 192. The other end of the cylinder 191 is connected at a pivot 193 to the mast plate 96. An adjustable link 194 is connected at a pivot 195 to the other end of link 188 and to the mast plate at a pivot 196 below pivot 193. Pivots 193 and 195 are positioned at spaced locations on the back side of the mast plate. When the cylinder 191 is retracted a vertical downward force is exerted on link 188 and in turn member 176 to move the scraper blade down, and when the cylinder is extended the scraper blade in turn is raised. This four-bar blade depth adjustment above described as well as inclined brace 97 and pivots 30 rigidly affixes the forward end of the leveler frame 31 to the mast plate 96 and central blade section A so they move up and down together during the leveling operation.

Figure 5:
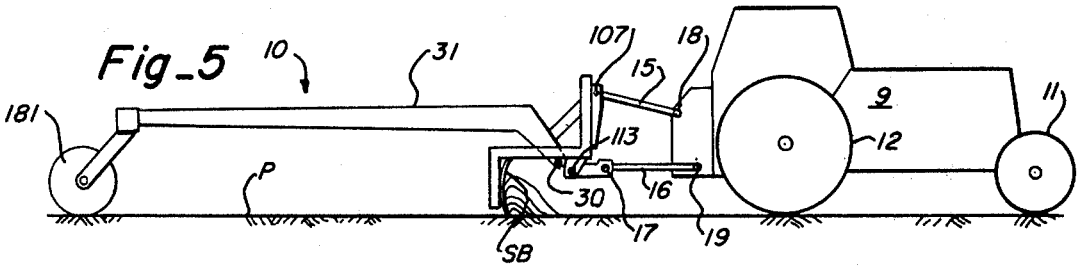
FIG. 5 is a side elevational view of the land leveling apparatus shown in FIGS. 1–4 on a flat or level grade plane with positions of the apparatus illustrated generally and some portions removed for clarity.
Figure 6:
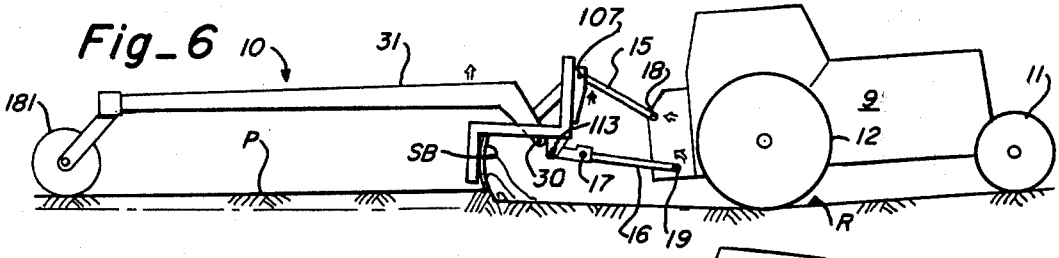
FIG. 6 is a side elevational view of the apparatus shown in FIG. 5 with the rear wheels in a recess and the front wheels raised as they move over a hump.
Figure 7:
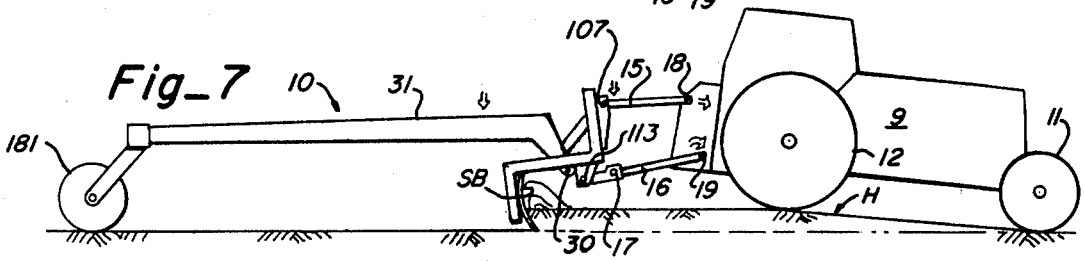
FIG. 7 is a side elevational view of the apparatus shown in FIG. 5 with the rear wheels raised to be on the hump.

The automatic level-adjusting assembly 31 hitched to the tractor as above described is shown to comprise an essentially four-sided or four-bar leveling linkage with opposite bars non-parallel to one another and with a pivot at each corner and functions to maintain the cutting blade assembly on a grade line designated P contacted by the front wheels 11 of the tractor and the trailing wheels 181 independently of the movement of the rear tractor wheels 12, as shown in FIGS. 5–7. This automatic leveling linkage is comprised of the upper link 15 pivotally connected to the tractor at pivot 18 and lower link 16 pivotally connected to the tractor at pivot 19, these links 15 and 16 being opposite and non-parallel to one another, as well as the rear axle housing 13 between pivots 18 and 19, and the rigid structure between pivots 107 and 113. The rigid structure between pivots 113 and 107 is one bar of the linkage that generally extends at a downward and rearward incline and is non-parallel to the opposite bar between pivots 18 and 19 that extends at a downward and forward incline. Pivot 107 is an upper rear control pivot and is adjustable up and down by virtue of the vertically spaced apertures in the mast plate. Pivot 113 is a lower rear pivot, pivot 18 is an upper front pivot and pivot 19 is a lower front pivot.

In the operation of this leveling linkage, as the front wheels 11 move up over a hump and/or the rear wheels move down in a depression for an upward tilt of the tractor, the tractor pivots counterclockwise about pivot 19, pivot 18 moves rearwardly to push link 15 and control pivot 107 rearwardly and upwardly about pivot 113 with pivot 113 and leveling frame 31 raising and in turn raising and tilting the mast plate slightly forward and raising and tilting the scraping blade SB slightly forward so that the scraper blade edge remains in the grade line or plane contacted by the front wheels of the tractor and the rear wheels of the leveling frame, and soil in the blade SB fills the depression R.

Conversely, when the rear wheels 12 of the tractor rise over the hump and the front wheels 11 move down so that there is a downward tilt of the tractor, as shown in FIG. 7 the tractor pivots in a clockwise direction about pivot 19, pivot 18 moves forwardly to pull link 15 and control pivot 107 downwardly and forwardly about pivot 113 with pivot 113 and leveling frame 31 lowering and in turn lowering and tilting the mast plate slightly back and lowering the scraper blade edge to cut off the hump, again with the position of the blade edge remaining in the plane P contacted by the front wheels of the tractor and the rear wheels 181 of the leveling frame.

The automatic leveling assembly apparatus and operation may be further understood by considering the upper rear control pivot 107 as a common pivot at the apex of a bridge-like structure having one forwardly and downwardly inclined bridge portion extending from the pivot 107 along the tractor through approximately the front wheels of the tractor and another rearwardly and downwardly inclined bridge portion extending generally along the leveling frame from pivot 107 through the center of the rear wheels 181 with the scraping blade SB being supported in a depending manner from these bridge portions and moving up and down as the control pivot 107 moves up and down. As the control pivot 107 is raised as shown in FIG. 6, the scraping blade is raised, and as the control pivot 107 is lowered as shown in FIG. 7 the scraping blade is lowered, but again at all times the triangulation of this bridge-like structure retains the scraping blade edge on a grade line or plane P contacted by the rear wheels 181 and front tractor wheels 11.

In this way, in the operation there is a cutting off of high spots and a filling of depressions, with the grade established by the front wheels of the tractor and the rear trailing wheels located a considerable distance apart with the movement of the rear wheels of the tractor not materially affecting the position of the blade.

In the event a lowering or raising of the scraping blade SB is required, hydraulic fluid is admitted to cylinder 191 which when retracted increases the depth and when extended raises the scraping blade SB.

Although the present invention has been described with a certain degree of particularity, it is understood that the present disclosure has been made by way of example and that changes in details of structure may be made without departing from the spirit thereof.

What is claimed is:

1. In land leveling apparatus including a land leveling attachment with a ground-working blade, a tractor having front and rear wheels, an upper link and a pair of lower links pivotally connected at their forward ends to the rear of the tractor to pivot up and down relative to the rear of the tractor and a crossbar secured to the rear ends of said lower links, the combination comprising:

a trailing leveling frame extending rearwardly from the attachment with a rear ground-engaging member supporting the attachment at the rear thereof for vehicular movement; and a hitch assembly for said attachment including:

first connecting means between the upper link and the attachment including an upright mast fixedly secured to the attachment and a first pivot about which the upper link and the attachment are pivotally movable up and down during vehicular movement, and second connecting means between the lower links and the attachment including a pair of laterally spaced lower hitch arms providing rotary motion of the lower hitch arms relative to the attachment about both a longitudinal axis and a lateral axis at said second pivot, said lower hitch arms having a forward end portion connected to said lower links and a rear end portion connected to said attachment, the connection at said rear end portion including said second pivot to afford independent up and down and twisting movement of either of the rear wheels of the tractor without substantial corresponding movement of the attachment, each of said lower hitch arms having a downwardly facing coupling socket at the forward end portions releasably receiving said crossbar, thus providing an intermediate pivot between the rear ends of the lower links and the forward ends of the lower hitch arms, each of said lower hitch arms having releasable retaining means retaining the crossbar in said coupling sockets.

2. In land leveling apparatus as set forth in claim 1 wherein each of said lower hitch arms is independently pivotally connected at its rear end to one side of the longitudinal center line of said attachment at a side pivot ball-type joint to provide said rotary motion, and further including link means for inhibiting inside lateral movement of the front end portions of said lower hitch arms.

3. In land leveling apparatus including a tractor having front and rear wheels, an upper link pivotally connected to and extending rearwardly from the tractor, and a pair of laterally spaced lower links pivotally connected to and extending rearwardly from the tractor, the combination comprising:

a sectional blade assembly including:

a central blade section;

two side blade sections pivotally connected at opposite ends of said central blade section to swing between a lowered position extending laterally out from an end of said central blade section and a raised position extending up from said central blade section;

drive means for moving said side blade sections between said lowered and raised positions including a power-actuated linkage means coupled between said central blade section and said side blade sections with a lock arrangement for retaining said side blade sections in the lowered position;

a leveling frame having rear ground-engaging wheels and a pair of laterally spaced forward end portions connected to the central blade section; and a hitch assembly for said blade assembly including:

first connecting means between the upper link and said central blade section including a mast affixed to and extending above said central blade section and a first pivot about which the upper link and the central blade section are pivotally movable up and down during vehicular movement, and second connecting means between the lower links and the central blade section including lower hitch arm means and a second pivot below said first pivot about which said central blade section and lower hitch arm means are pivotally movable up and down during vehicular movement, said lower hitch arm means having a forward end portion connected to said lower links and a rear end portion connected to said support, the connection at said rear end portion including said second pivot to provide a leveling linkage formed by the upper link, the structure between the mast and the lower hitch arm means, the lower links and the pivotal connections therebetween being such that a scraping edge of said central and side blade sections is automatically maintained substantially in a ground plane contacted by the front wheels of the tractor and the rear wheels of the leveling frame.

4. In land leveling apparatus as set forth in claim 3 wherein said laterally spaced forward end portions turn down at an angle in relation to substantially horizontal rearwardly extending portions.

5. In land leveling apparatus as set forth in claim 3 wherein each of said rear wheels on said leveling frame has a selected caster angle and a selected camber angle to avoid having the scraping blade edges dig into the ground being leveled during turns.

6. In land leveling apparatus including a tractor having front and rear wheels, an upper link pivotally connected to and extending rearwardly from the tractor, and a pair of laterally spaced lower links pivotally connected to and extending rearwardly from the tractor, the combination comprising:

a scraping blade on a support;

a leveling frame having rear ground-engaging means and a forward end portion connected to the support for said blade; and a hitch assembly for said blade including:

first connecting means between the upper link and said scraping blade including a mast movable with and extending above said blade and a first pivot about which the upper link and the scraping blade are pivotally movable up and down during vehicular movement, and second connecting means between the lower links and the scraping blade including lower hitch arm means and a second pivot below said first pivot about which said scraping blade and lower hitch arm means are pivotally movable up and down during vehicular movement, said lower hitch arm means having a forward end portion connected to said lower links and a rear end portion connected to said support, the connection at said rear end portion including said second pivot to form leveling linkage between the rear of the tractor and said blade whereby said blade follows the vertical movement of said first pivot means and a lower scraping edge of said blade is maintained substantially in a ground plane contacted by the front wheels of the tractor and the rear ground-engaging means of the leveling frame.

7. In land leveling apparatus including a land leveling blade and a tractor having front and rear wheels and having upper link means and lower link means pivotally connected at the forward end portions to the rear of the tractor to pivot up and down relative to the rear of the tractor, the combination comprising:

a trailing leveling frame extending rearwardly from the blade with a rear ground-engaging member supporting the blade at the rear for vehicular movement; and a hitch assembly for said blade including:

first connecting means between the upper link and an upper portion of the blade including a first pivot about which the upper link and the blade are pivotally movable up and down during vehicular movement, and second connecting means between the lower link means and a lower portion of the blade including lower hitch arm means and a second pivot below said first pivot about which said central blade section and lower links are pivotally movable up and down during vehicular movement, said lower hitch arm means having a forward end portion connected to said lower link means and a rear end portion connected to said blade, the connection at said rear end portion including said second pivot to provide a leveling linkage formed by said upper link means, the structure between the mast and the lower hitch arm means, the lower hitch arm means, the lower link means and the pivotal connections therebetween, whereby the blade moves vertically independently of the vertical movement of the rear wheels of the tractor.

8. In land leveling apparatus as set forth in claim 7 including an intermediate pivot between the rear end of said lower hitch arm means and said lower link means for further vertical movement of the rear wheels of the tractor relative to said blade.

9. In land leveling apparatus as set forth in claim 8 wherein said intermediate pivot is provided by a crossbar carried by the rear end portions of said lower link means.

10. In land leveling apparatus as set forth in claim 7 wherein said lower hitch arm means includes a pair of laterally spaced lower hitch arms coupled at their rear ends for movement relative to the blade about both a longitudinal axis and a lateral axis for twisting and up and down movement of the rear of the tractor independently of said blade.

11. In land leveling apparatus as set forth in claim 10 wherein each of said lower hitch arms has a bifurcated forward end portion open to slidably receive a rear end portion of said lower link means and a socket opening along the underside for slidably receiving a crossbar carried by the rear end portion of said lower link means.

12. In land leveling apparatus including a land leveling attachment and a tractor having front and rear wheels and having an upper link pivotally connected at the front end at the rear of the tractor and a pair of lower links pivotally connected at their forward ends at the rear of the tractor, the combination comprising:

a leveling frame extending rearwardly from the attachment with a rear ground-engaging member supporting the attachment at the rear for vehicular movement; and a hitch assembly for said attachment including:

first connecting means between the upper link and the attachment including a mast fixedly secured to said attachment and a first pivot about which the upper link and the attachment are pivotally movable up and down during vehicular movement, and second connecting means between the lower links and the attachment including a pair of laterally spaced lower hitch arms and a second pivot below said first pivot about which said attachment and lower hitch arms are pivotally movable up and down, said lower hitch arms having a forward end portion connected to said lower links and a rear end portion connected to said attachment, the connection at said rear end portion including said second pivot for movement of the lower hitch arms about both a longitudinal axis and a lateral axis for twisting and vertical movement of the tractor independently of said blade, said second connecting means including a third pivot about which the lower links and lower hitch arms are pivotally movable up and down during vehicular movement to provide a lower intermediate movable pivot between said lower hitch arms and the lower links carried by the tractor, whereby a leveling linkage is formed by the upper link, the structure between the mast and the hitch arms, the hitch arms, the lower links, and the pivotal connections therebetween being such that the attachment may move substantially vertically independently of the vertical movement of the rear wheels of the tractor.

13. In a ground-working assembly including a trailing attachment with a ground-working tool and a tow vehicle for said attachment having front and rear wheels, an upper link pivotally connected at a forward end portion to said tow vehicle for pivotal up-and-down movement relative to the tow vehicle, and lower link means pivotally connected at a forward end portion to said tow vehicle for pivotal up-and-down movement relative to the tow vehicle, the combination comprising:

a leveling frame extending rearwardly from the tool with a rear ground-engaging member supporting the attachment at the rear thereof for vehicular movement; and a hitch assembly for said attachment including:

first connecting means between said upper link and the attachment including a first pivot about which said upper link and attachment are pivotally movable up and down during vehicular movement, and second connecting means between said lower link means and said attachment including lower hitch arm means and a second pivot below said first pivot about which said attachment and said lower hitch arm means are pivotally movable up and down during vehicular movement, said lower hitch arm means having a forward end portion connected to said lower link means and a rear end portion connected to said attachment, the connection at said rear end portion including said second pivot to provide a leveling linkage between the pivotal connections at the forward end portions of said upper link and lower link means together with said first and second pivots whereby the tool moves vertically independently of the vertical movement of the rear wheels of the tow vehicle and in relation to a ground plane contacted by the front wheels of the tow vehicle and the rear ground-engaging member during the vehicular movement of the tow vehicle and trailing attachment, said second connecting means including a third pivot between said forward end portion of said lower hitch arm means and said rear end portion of said lower link means about which said lower link means and said lower hitch arm means are pivotally movable up and down during vehicular movement.

14. In a ground-working assembly as set forth in claim 13 wherein said first pivot is above the pivotal connection of the upper link with the tow vehicle and forms the apex of a bridge-like support structure for the ground-working tool extending generally downwardly and forwardly via the upper link and tow vehicle to the front wheels and generally downwardly and rearwardly to the rear ground-engaging member with the tool generally following the up-and-down movement of the first pivot during vehicular movement.

* * * * *